US008966935B2

(12) United States Patent
Nelson

(10) Patent No.: US 8,966,935 B2
(45) Date of Patent: Mar. 3, 2015

(54) HEAT EXCHANGER

(75) Inventor: Bruce I. Nelson, Colville, WA (US)

(73) Assignee: Colmac Coil Manufacturing, Inc., Colville, WA (US)

( * ) Notice: Subject to any disclaimer, the term of this patent is extended or adjusted under 35 U.S.C. 154(b) by 456 days.

(21) Appl. No.: 13/527,958

(22) Filed: Jun. 20, 2012

(65) Prior Publication Data

US 2013/0340979 A1 Dec. 26, 2013

(51) Int. Cl.
*F25B 39/02* (2006.01)

(52) U.S. Cl.
USPC ..... 62/525; 62/112; 165/104.26

(58) Field of Classification Search
USPC ..... 62/112, 498, 509, 525; 165/104.26, 165/174, 178
See application file for complete search history.

(56) References Cited

U.S. PATENT DOCUMENTS 2,171,560 A 9/1939 Holmes et al.
3,070,963 A 1/1963 Dubouchet
3,665,714 A 5/1972 Bunger
4,577,468 A * 3/1986 Nunn et al. ..... 62/113
5,674,029 A 10/1997 Smith et al.
7,958,738 B2 6/2011 Nelson
2001/0013226 A1* 8/2001 Potnis et al. ..... 62/271
2009/0301112 A1* 12/2009 Nelson ..... 62/112

OTHER PUBLICATIONS

Unknown, Weir Calibration, Technical publication, pp. 1-4.

* cited by examiner

*Primary Examiner* — Melvin Jones
(74) *Attorney, Agent, or Firm* — Paine Hamblen, LLP

(57) ABSTRACT

A heat exchanger is described and which includes a heat exchanger portion defining a multiplicity of internal passageways, and wherein at least one of the passageways is defined in part by a wicking structure; a refrigerant distributor coupled in fluid flowing relation relative to the defined passageways of the heat exchanger portion; and a source of ammonia refrigerant which is supplied to the internal passageways of the heat exchanger portion, and wherein substantial equal amounts of liquid refrigerant are supplied to each of the passageways defined by the heat exchanger portion.

31 Claims, 9 Drawing Sheets

200

207
202
204
CROSS-HATCHED KNURLS
A2 - A2
FIG. 5A2
208
209
FIG. 5B2
202
206
204
WICKING STRUCTURES
HELICAL GROOVING
A1 - A1
FIG. 5A1
83
202
204
208
SINTERING
B - B
FIG. 5B1
83
210
204
WIRE MESH
C - C
FIG. 5C1
A1
A2
206
A1
A2
83
204

B
208
B
83
204

C
210
C
83
204

HEAT EXCHANGER

TECHNICAL FIELD

The present invention relates to a heat exchanger, and more particularly to a heat exchanger which finds particular utility, and usefulness, in the direct contact cooling of processed food products.

BACKGROUND OF THE INVENTION

Direct contact cooling of processed food products has been widely used in the food processing industry since the 1960s. The direct contact cooling units, or "plate freezers" as identified within the industry, are traditionally constructed of individual planks which are coupled together through welding or other traditional means. Each of these planks contain internal passageways, through which a volatile refrigerant is introduced. The evaporation of the volatile refrigerant absorbs ambient heat and cools the surface of the planks, which in turn, cools the product which is resting on the surface of the planks. Traditionally, multiple planks forming the respective plates have been arranged in either vertical or horizontal orientations for large scale freezing operations.

Although somewhat effective in cooling various food products for example, the traditional direct contact freezers have fundamental performance, as well as potentially health hazardous, deficiencies. When cooling performance deficiencies manifest themselves in these prior art designs, the traditional industry response, heretofore, has been in the form of utilizing larger volumes of volatile refrigerant, with corresponding low coefficients of freezing. The need for large volumes of volatile refrigerant, as discussed above, has been viewed as a potential health hazard in that traditionally designed direct contact plate freezers have proven occasionally to leak refrigerant during repeated freezing or processing cycles.

Traditional direct contact plate freezers supply the volatile refrigerant to the associated freezing planks through flexible hoses or conduits. These flexible hoses are commonly connected to an intake manifold. Further, individual flexible hoses or conduits are typically coupled to a common suction manifold which is used for refrigerant removal. The respective hoses are traditionally connected to the aforementioned manifolds via a threaded stainless steel fitting. Inasmuch as the freezer planks are constructed of aluminum, there exists a difference in the linear coefficient of thermal expansion between the stainless steel connections and the respective aluminum planks. Because of this difference, the threaded connections are unavoidably the source of refrigerant leakage, and therefore poses an imminent threat to human health especially when refrigerants such as ammonia is employed.

Another issue facing manufacturers of frozen processed products is the inability to obtain a uniform distribution of the liquid refrigerant. Typically, the uniform distribution of the liquid refrigerant is accomplished by the use of fixed orifices which are mounted at each flexible hose connection. While this arrangement seems to work well, when subcooled liquid refrigerant is supplied to the common intake manifold, any flash gas entering the common intake manifold will rise to the top of the manifold and result in a restriction of the flow of the liquid refrigerant to the top or more elevationally oriented direct contact plates. It should be understood that flash gas is usually formed in the common intake manifold at the end of the freezing cycle if the flow rate of the refrigerant is reduced by throttling or the temperature of the refrigerant is permitted to approach its saturation temperature. The formation of flash gas, and the resulting non-uniform distribution of the liquid refrigerant causes unintended consequences in the freezing process. For example, as the top direct contact plates are "starved" of liquid refrigerant, the bottom direct contact plates have an abundance of liquid refrigerant. This situation results in an unequal freezing of individual items or products which are placed on the top direct contact plates (under-freezing), versus those placed on the bottom direct contact plates (over-freezing).

A similar problem associated with the non-uniform distribution of liquid refrigerant arises when the liquid refrigerant assumes a stratified or wavy flow pattern in the internal passageways of the respective direct contact plates. This stratified or wavy flow pattern is normally an artifact of the traditional construction of the internal passageways within the direct contact plates. The teachings of my U.S. Pat. No. 7,958,738 are incorporated by reference herein, and discuss this same problem.

Traditionally, to overcome the aforementioned problem of non-uniform distribution of the liquid refrigerant, and the formation of stratified or wavy flow patterns within the internal passageways of the direct contact plates, has been to significantly increase the flow rate of the liquid refrigerant. While increased flow rates of the liquid refrigerant will appear to address or mask, to some degree, the adverse effects of the non-uniform distribution of liquid refrigerant and the stratified or wavy flow patterns, it can result in overfeed ratios of the liquid refrigerant as high as 20:1. This overfeed of the liquid refrigerant can result in a significant waste of energy, the need for large volumes of liquid refrigerant, and the associated, potential health hazards posed by large volumes of a volatile liquid refrigerant, in the event that a liquid refrigerant leak occurs.

As most frozen food products are high value-added products, direct contact freezing performance, and throughput is critical to conducting a profitable operation. The problems associated with non-uniform distribution of liquid refrigerant, the need for large volumes of liquid refrigerant, and the associated human health hazards associated with a refrigerant leak, all potentially reduce the profitability of this industry.

It has long been known therefore, that it would be desirable to provide an improved direct contact plate freezing system which may be utilized in the frozen food industry, for example, and which avoids the inherent problems associated with the prior art practices and substantially reduces the potential for health problems for workers in close proximity to the traditional direct contact plate freezing systems discussed, above. Resolution of the above discussed deficiencies is the subject matter of the present invention, as will be described in greater detail hereinafter.

SUMMARY OF THE INVENTION

Therefore, a first aspect of the present invention relates to a heat exchanger which includes a heat exchanger portion defining a multiplicity of internal passageway, and wherein at least one of the passageways is defined, at least in part, by a wicking structure; a refrigerant distributor coupled in fluid flowing relation relative to each of the internal passageways of the heat exchanger portion; and a source of an ammonia refrigerant which is supplied to the internal passageways of the heat exchanger portion by the refrigerant distributor, and wherein the source of refrigerant is first provided to the refrigerant distributor, and further has a liquid and vapor phase condition, and wherein the source of the ammonia refrigerant is further supplied to the refrigerant distributor at a given flow rate, and wherein the refrigerant distributor distributes substantially equal amounts of the ammonia refrigerant to each of the internal passageways of the heat exchanger portion regardless of the liquid or vapor phase condition of the ammonia refrigerant, or the refrigerant flow rate which is supplied to the refrigerant distributor.

A second aspect of the present invention relates to a heat exchanger which includes a plurality of heat exchanger portions each defining a multiplicity of internal passageways, and wherein at least some of the internal passageways are defined, at least in part, by a wicking structure; a refrigerant supply assembly having a weir, and which is mounted on each of the respective heat exchanger portions, and which is further coupled in fluid flowing relation relative to the multiplicity of internal passageways; a refrigerant distributor which supplies substantially equal amounts of a source of a refrigerant to each of the respective refrigerant supply assemblies; a plurality of refrigerant delivery conduits coupling the respective refrigerant supply assemblies in fluid flowing relation with the refrigerant distributor; and a bimetallic coupler which is affixed in fluid flowing relation relative to each of the refrigerant supply assemblies and with one of the refrigerant delivery conduits.

Still yet another aspect of the present invention relates to a heat exchanger which includes a plurality of heat exchanger portions, and which each has formed therein a multiplicity of internal passageways that are defined by an internal wall, and which individually allow for the movement of a source of a refrigerant, having both liquid and vapor portions, therethrough, and wherein the internal passageways are defined, at least in part, by a wicking structure which is effective, by capillary force, to draw the liquid refrigerant up onto the internal wall, and which defines the respective internal passageways; a refrigerant supply assembly mounted on each of the heat exchanger portions, and which is further coupled in fluid flowing relation relative to the respective internal passageways which are defined by the individual heat exchanger portions, and wherein each of the refrigerant supply assemblies has a weir which controls the flow of the liquid refrigerant which is supplied to the respective internal passageways that are defined by the individual heat exchanger portions; a refrigerant distributor which supplies substantially equal amounts of the source of the refrigerant to each of the respective refrigerant supply assemblies; a plurality of refrigerant delivery conduits each having a first, intake end which is coupled in fluid receiving relationship relative to the refrigerant distributor, and a second, refrigerant discharge end which is coupled in fluid delivering relationship relative to each of the respective refrigerant supply assemblies; and a bimetallic coupler which is affixed to each of the respective refrigerant supply assemblies, and to the respective refrigerant discharge end of each of the individual refrigerant delivery conduits.

Moreover, another aspect of the present invention relates to a heat exchanger which includes a plurality of heat exchanger portions, and which each has formed therein a multiplicity of internal passageways that are defined by an internal wall, and which individually allow for the movement of a source of a refrigerant, having both liquid and vapor portions, therethrough, and wherein the internal passageways are defined, at least in part, by a wicking structure which is effective, by capillary force, to draw the liquid refrigerant up onto the internal wall, and which defines the respective internal passageways, and wherein the plurality of heat exchanger portions further include metal plates which are formed of individual metal planks which are fastened together, and wherein the internal passageways formed in the respective planks are substantially circular in cross-section, and have a predetermined diametral dimension (D), and wherein the internal passageways are further located at a predetermined distance or pitch from an adjacent internal passageway (L), and wherein the ratio of L/D is greater than about 1.3; a refrigerant supply assembly mounted on each of the heat exchanger portions, and which is further coupled in fluid flowing relation relative to the respective internal passageways which are defined by the individual heat exchanger portions, and wherein each of the refrigerant supply assemblies has a weir which controls the flow of the liquid refrigerant which is supplied to the respective internal passageways that are defined by the individual heat exchanger portions, and wherein the refrigerant supply assembly further has a main body with opposite first and second ends, and which defines an internal cavity that extends between the opposite first and second ends, and wherein the internal cavity defines a reservoir for receiving the liquid refrigerant delivered to the liquid supply assembly by a refrigerant distributor, and wherein the weir is made integral with the refrigerant supply assembly and is operable to control the flow of the liquid refrigerant supplied to the reservoir to the respective internal passageways; and wherein a plurality of baffles are mounted within the internal cavity of the refrigerant supply assembly and which are located in predetermined spaced relation between the first and second ends thereof, and which individually operate to redirect the flow of the source of the refrigerant flowing along the respective internal passageways; a refrigerant distributor which supplies substantially equal amounts of the source of the refrigerant to each of the respective refrigerant supply assemblies; and wherein the refrigerant distributor includes a tank defining an internal cavity for receiving the source of refrigerant which has both a liquid and vapor portion; an inlet conduit for delivering the source of the refrigerant to the internal cavity of the tank, and wherein the inlet conduit has a first intake end, and a second exhaust end which is located within the internal cavity of the tank, and wherein the second, exhaust end is defined by an upper and lower exhaust aperture; a contaminant collection container coupled in fluid receiving relation relative to the internal cavity of the tank, and wherein the second exhaust aperture of the inlet conduit is disposed in fluid delivering relation relative thereto; a plurality of refrigerant distributor conduits coupled in fluid flowing relation relative to the internal cavity of the tank, and wherein each of the refrigerant distributor conduits has a first intake end, and a second exhaust end, and wherein the first intake end of the respective refrigerant distributor conduits are substantially vertically oriented within the internal cavity of the tank, and a multiplicity of apertures are formed in each of the first ends of the respective refrigerant distributor conduits, and wherein the multiplicity of apertures each have a cross-sectional dimension which diminishes when the cross-sectional dimension is measured from the first intake end of respective refrigerant distributor conduits, and in the direction of the second exhaust end thereof, and wherein the second, exhaust end is coupled in fluid flowing relation relative to the respective refrigerant supply assemblies; and a bimetallic coupler which is affixed to each of the respective refrigerant supply assemblies, and to the respective second exhaust end of each of the individual refrigerant delivery conduits.

These and other aspects of the present invention will be described in greater detail hereinafter.

BRIEF DESCRIPTION OF THE DRAWINGS

FIG. 3A-3E are transverse, vertical, sectional views taken from various positions along lines 3A-3A, 3B-3B, 3C-3C, 3D-3D, and 3E-3E of FIG. 3.

FIG. 5A1 is a longitudinal, vertical, sectional view taken from a position along line A1-A1 of FIG. 5A.

FIG. 5A2 is a longitudinal, vertical, sectional view taken from a position along line A2-A2 of FIG. 5A.

FIG. 5B1 is a longitudinal, vertical, sectional view taken from a position along line B-B of FIG. 5B.

FIG. 5B2 is a greatly exaggerated, functional depiction of a portion of the structure as seen in FIG. 5B1, as indicated by the arrow.

FIG. 5C1 is a longitudinal, vertical, sectional view taken from a position along line C-C of FIG. 5C.

DETAILED DESCRIPTION OF THE PREFERRED EMBODIMENTS

This disclosure of the invention is submitted in furtherance of the constitutional purposes of the U.S. Patent Laws "to promote the progress of science and the useful arts" (Article I, Section 8).

Referring more specifically to the drawings, the present invention provides a novel means, as will be discussed in greater detail hereinafter, for mitigating the sometimes disappointing refrigeration performance, and potential health hazards which has been occasionally associated with the prior art direct contact plate cooling units which have been used, heretofore.

As was discussed previously in the background section of the present invention, a well known deficiency of the currently employed direct contact plate cooling units or devices has been the non-uniform distribution of liquid ammonia refrigerant within same, due to the formation of flash gas, and the further development and/or existence of stratified or wavy flow movement of the liquid ammonia refrigerant within the internal passageways of the freezer planks which form a part of the direct contact cooling plates. As noted earlier, the traditional industry response to the aforementioned cooling performance shortcomings has been to increase the load (volume) of liquid ammonia refrigerant supplied to the direct contact cooling plates. As previously discussed, this increased loading of the liquid ammonia refrigerant, in conjunction with traditional fluid coupling methods which are employed between the prior art refrigerant distribution units, and the direct contact cooling plates, can lead to the leaking of liquid ammonia refrigerant and the associated health hazards of the refrigerant exposure to nearby workers.

Figure 1:
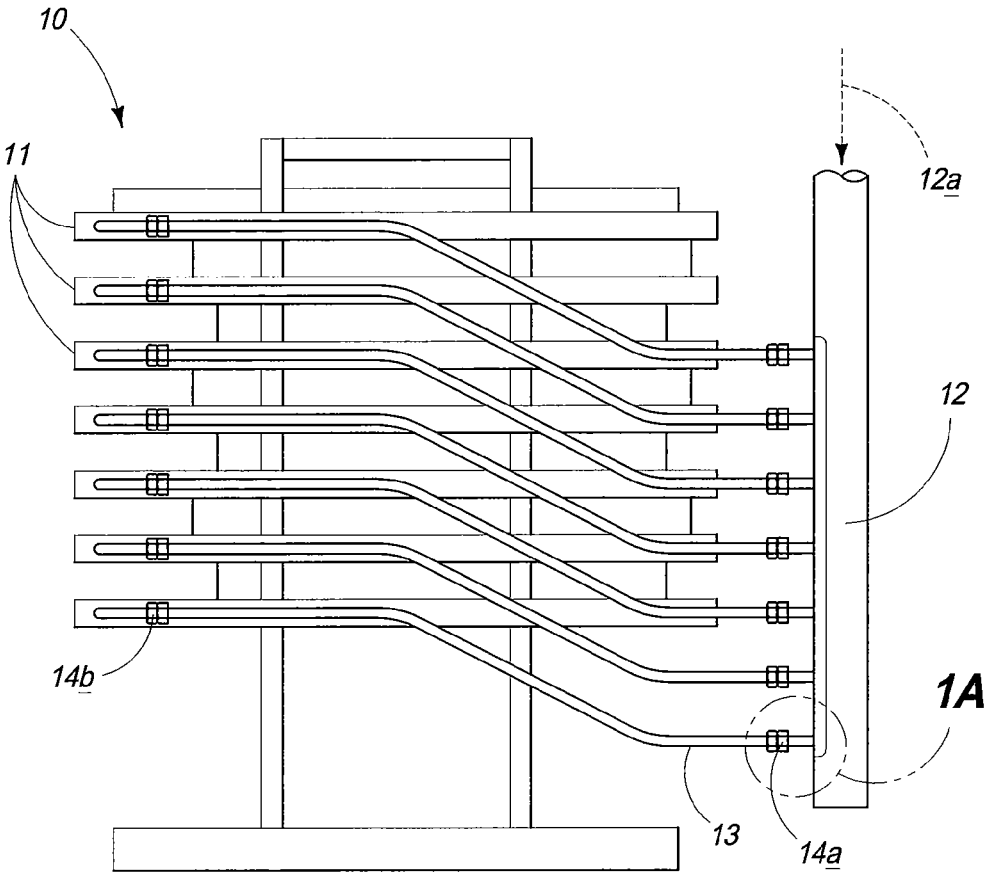
PRIOR ART FIG. 1
FIG. 1 illustrates a typical prior art plate freezer arrangement.

Referring now to FIG. 1, a prior art plate freezer, as employed in a prior art direct contact plate cooling system is generally indicated by the numeral 10. The structure includes a plurality of moveable, direct contact freezing plates 11. The plurality of direct contact freezing plates 11 are fluid flowingly connected to a liquid ammonia refrigerant feed manifold 12 by a plurality of flexible hoses or conduits 13. A source of liquid ammonia refrigerant 12A is distributed to each of the flexible hoses 13 by the liquid ammonia refrigerant manifold 12. Further, the flexible hoses or conduits 13 are connected to both the liquid ammonia refrigerant manifold 12, and the direct contact freezing plates 11 by way of individual threaded stainless steel fittings 14*a* and 14*b*, respectively.

Figure 1A:
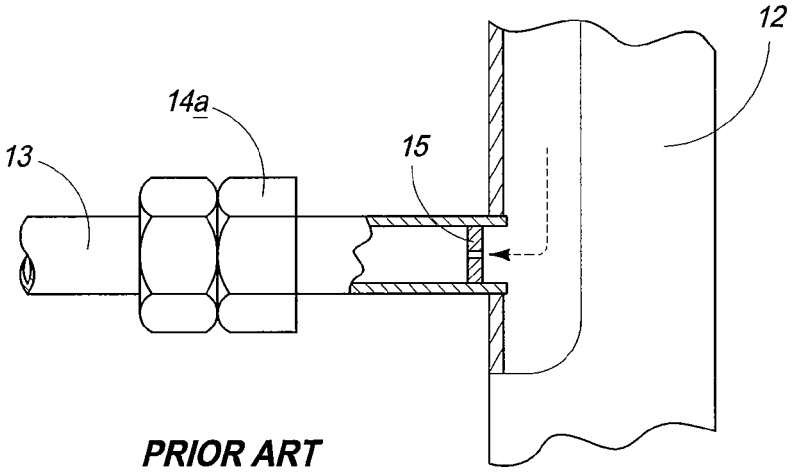
PRIOR ART FIG. 1A
FIG. 1A illustrates a typical fixed orifice arrangement as used in prior art plate freezers as seen in FIG. 1.

Referring now to FIG. 1A, which shows an enlarged depiction of an aspect of FIG. 1, a prior art threaded stainless steel fitting 14*a* is depicted as fluid flowingly coupling the flexible hose 13, and the liquid ammonia refrigerant manifold 12. Also shown in FIG. 1A is a prior art fixed orifice 15. The fixed orifice 15 has been used, heretofore, to control the flow of the liquid ammonia refrigerant 12A, and to create a substantially uniform distribution of the liquid ammonia refrigerant 12A throughout the direct contact freezing plates 11.

In the prior art arrangement as shown in FIG. 1 it should be noted that the respective prior art threaded stainless steel fittings 14*b* are directly screw-threadably coupled with an aluminum conduit. Due to the differences in the linear coefficient of expansion which exists between stainless steel and aluminum, the prior art stainless steel threaded fittings 14*b* are unavoidably a source of liquid ammonia refrigerant leaks in prior art structures as seen in FIG. 1.

Figure 2:
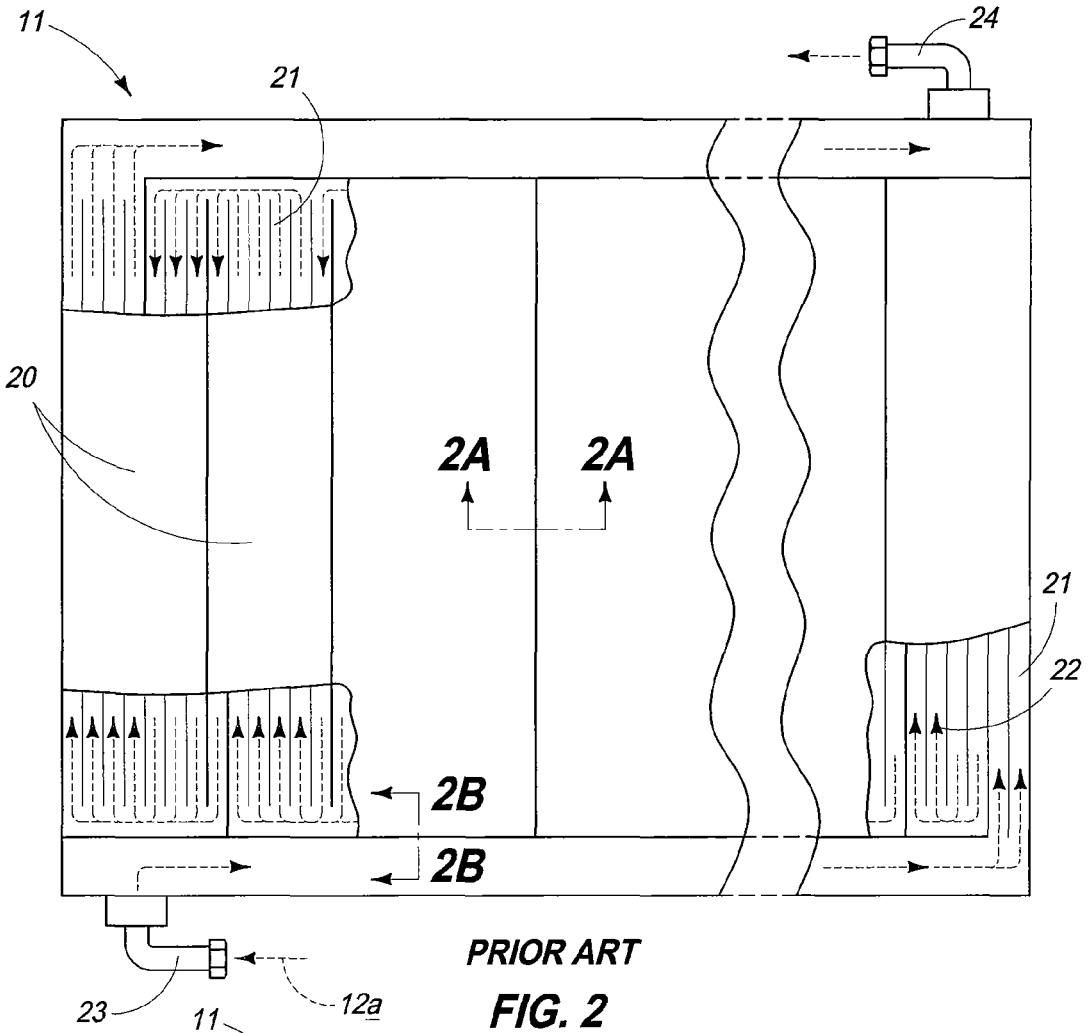
PRIOR ART FIG. 2
FIG. 2 illustrates a prior art plate freezer having multiple extruded planks which provide passageways for the flow of refrigerant.
Figure 2A:
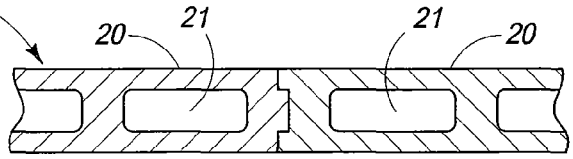
PRIOR ART FIG. 2A
FIG. 2A illustrates a transverse vertical sectional view of a prior art plate freezer and which is taken from a position along line 2A-2A of FIG. 2.
Figure 2B:
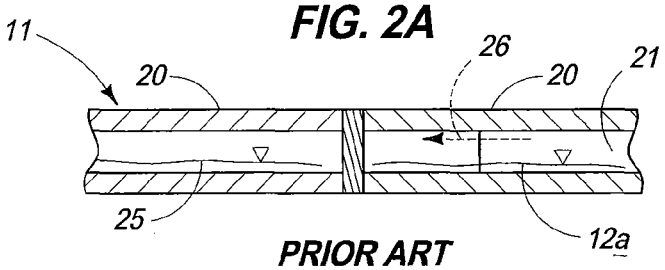
PRIOR ART FIG. 2B
FIG. 2B illustrates a second transverse vertical sectional view taken from a position along line 2B-2B of FIG. 2.
Figure 3:
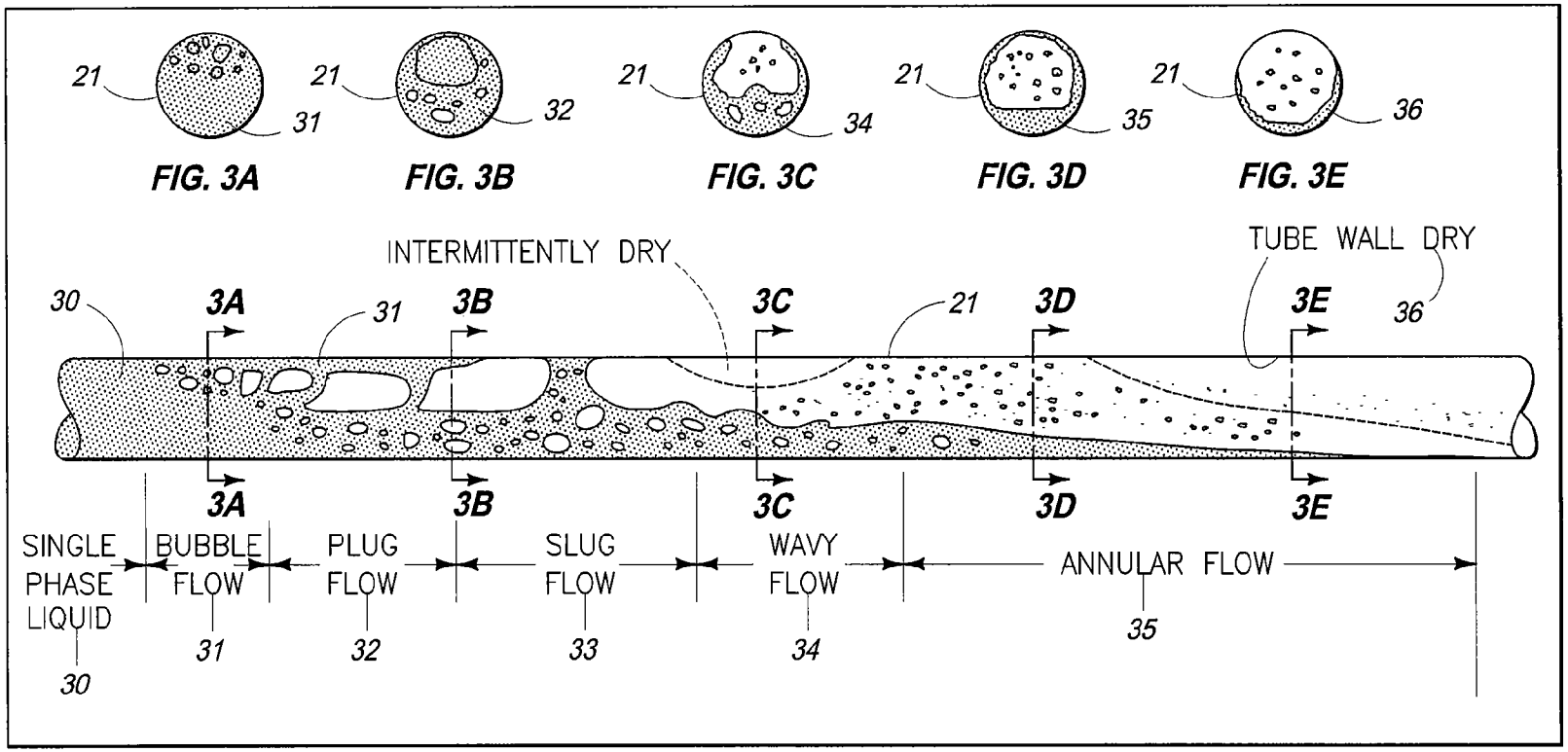
PRIOR ART FIG. 3
FIG. 3 is a longitudinal vertical sectional view taken through a prior art, smooth inside diameter, horizontal evaporator tube and which shows the refrigerant flow pattern exhibited by same.

Referring now to FIG. 2, this drawing shows a top plan view of a prior art direct contact plate freezer 11 and its constituent individual portions, which are typically referred to as "planks" 20. The individual planks 20 contain multiple internal passageways 21, which can best be seen in FIG. 2A. The multiple internal passageways which are generally rectangularly shaped (FIG. 2A) are machined, molded or cast to create a flow or refrigerant pathway 22 for the liquid ammonia refrigerant 12A. The liquid ammonia refrigerant enters the internal passageways 21 through a fixed liquid intake connection or conduit 23 which is typically located at one corner of the direct contact plate freezer 11. Further, the refrigerant 12A exits the internal passageways 21 through a fixed liquid suction or exhaust connection or conduit 24 that is located at an opposite corner of the direct contact plate freezer 11. While the liquid ammonia refrigerant 12A is within the internal passageways 21 of the direct contact plate freezer 11, the flow pathway 22 channels the refrigerant in a back and forth or serpentine like path of travel, as can best be seen in FIG. 2. In this prior art design 10, the two phase flow pattern of the liquid ammonia refrigerant 12(*a*) is invariably stratified or wavy (FIG. 3). This results in the separation of the liquid phase ammonia 25, and vapor phase ammonia 26, within the internal passageways, as can best be seen in FIG. 2B. This flow pattern will be discussed in greater detail, hereinafter.

Referring now to FIG. 3, a multiplicity of two-phase refrigerant flow patterns which may be experienced during evaporation of the liquid ammonia refrigerant 12(*a*) in smooth inside diameter, substantially horizontally disposed evaporator tubes or substantially circular shaped fluid passageways, (not shown), is illustrated. When viewing FIG. 3, it should be understood that the flow of the liquid ammonia refrigerant is from the left side of the drawing to the right side of the drawing. The flow of the refrigerant includes a single phase liquid region 30; a bubble region 31; a plug flow region 32; a slug flow region 33; a wavy flow region 34; an annular flow region 35; and a dry wall flow region 36. Not every region may be present at any one time depending upon the design of internal passageway 21. As seen in this drawing, and with a substantially smooth inside diameter internal passageway 21, the highly desirable annular flow pattern is generally indicated by the numerals 35 and 36, respectively, and which are seen in FIGS. 3D and 3E, respectively. This particular flow pattern is created by vapor shear forces. Still further, the highly undesirable stratified-wavy flow patterns, as seen in FIG. 3C, and which are indicated by the numeral 34, unavoidably is generated by the prior art direct contact plate freezing systems, as seen in FIG. 1. In this regard, a prior art direct contact plate freezing system operating at low temperatures operates predominantly in the stratified, wavy flow region 34. The stratified wavy flow region, as seen in FIG. 3C, appears to severely restrict the cooling performance and the effective use of prior art direct expansion ammonia refrigeration systems [direct contact plate freezing systems] as described earlier. A comparison of the performance of the prior art plate freezer arrangements and that of the present invention is graphically depicted in FIG. 7.

Figure 8:
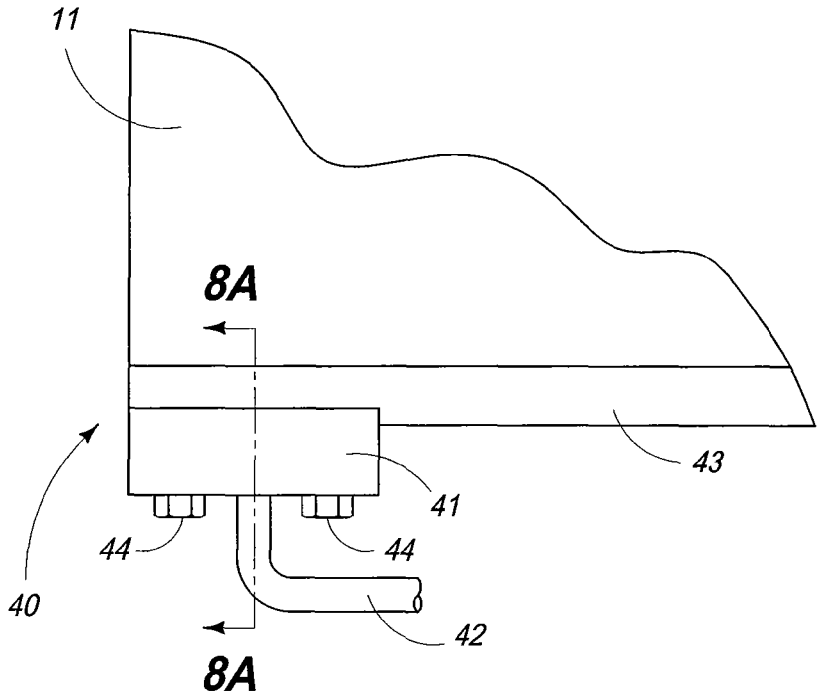
PRIOR ART FIG. 8
FIG. 8 depicts a typical manifold coupling used to connect a source of refrigerant with a prior art plate freezer.

Referring now to FIG. 8, this drawing illustrates a prior art intake manifold coupling 40. As a general matter, this prior art manifold coupling 40 includes an aluminum block 41 which is drilled and tapped 40A (FIG. 8A) to accept a threaded stainless steel refrigerant tube 42. The aluminum block 41 is connected to the direct contact plate freezer manifold extrusion 43 by threaded bolts 44.

Figure 8A:
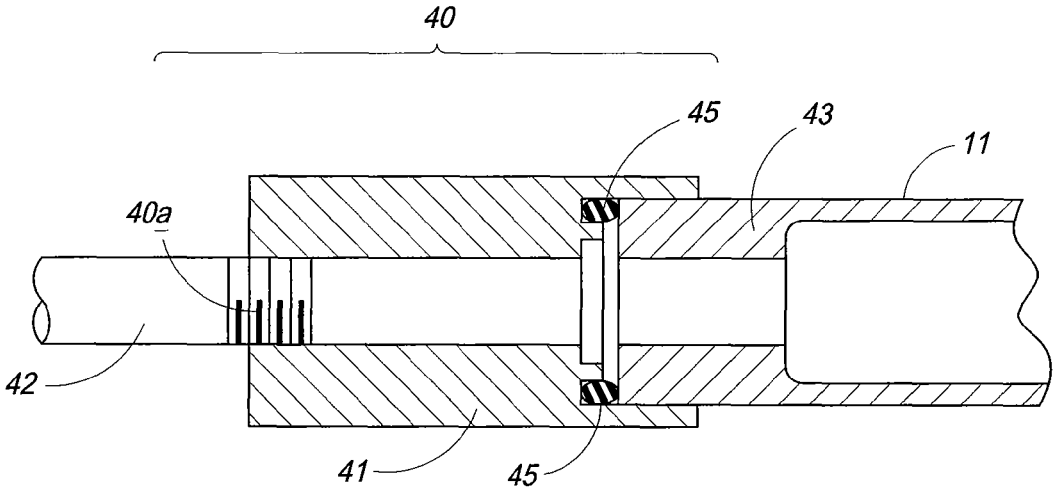
PRIOR ART FIG. 8A
FIG. 8A depicts a transverse, vertical, sectional view taken from a location along line 8A-8A of FIG. 8.

As can best be seen in FIG. 8A, and which shows a transverse, vertical, sectional view taken from a location along line 8A-8A of FIG. 8, the aluminum block 40 manifold extrusion interface is coupled in fluid sealing relation to the intake manifold extrusion 43 by means of an 0-ring 45. As discussed above, by reference to FIG. 1, the prior art method of connecting stainless steel threaded fittings, as seen in FIG. 8, to an aluminum conduit, or an aluminum block 41, causes problems because it is typically a source of liquid ammonia refrigerant leaking. This leaking of liquid ammonia refrigerant in prior art structures utilizing stainless steel to aluminum interfaces is due to the differences in the linear coefficient of expansion between stainless steel and aluminum.

Figure 4:
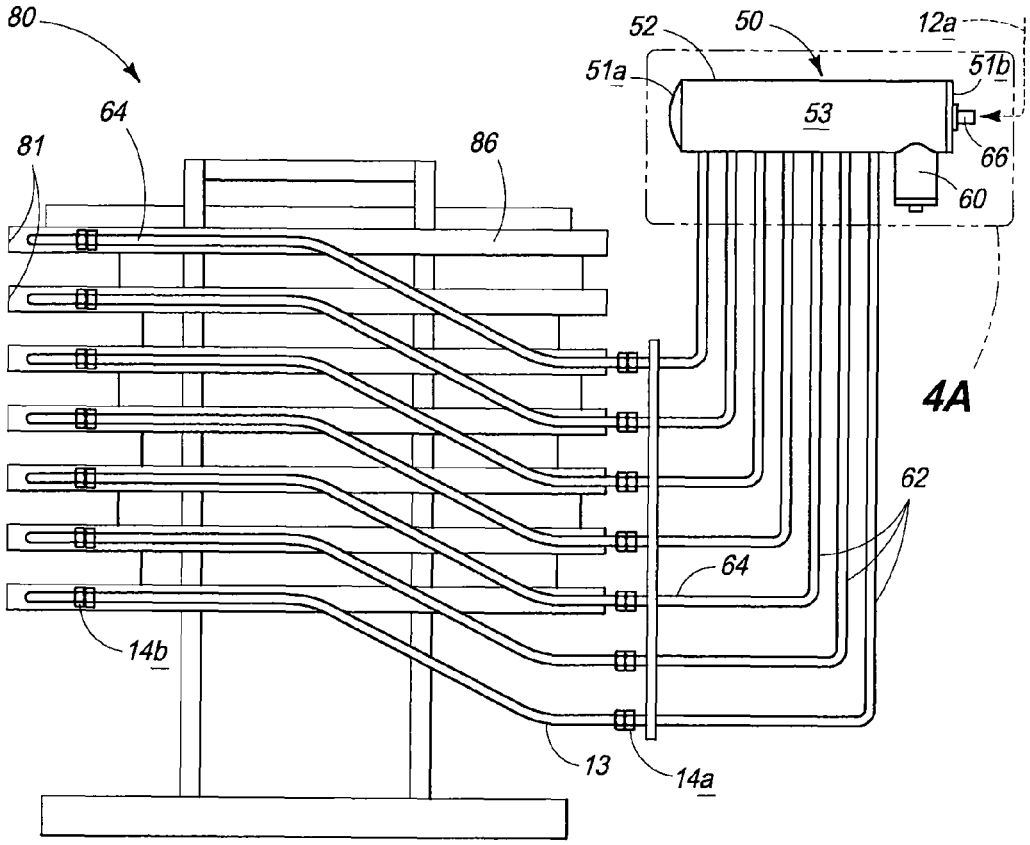
FIG. 4 illustrates a fragmentary, environmental, side elevation view of the present invention.
Figure 4A:
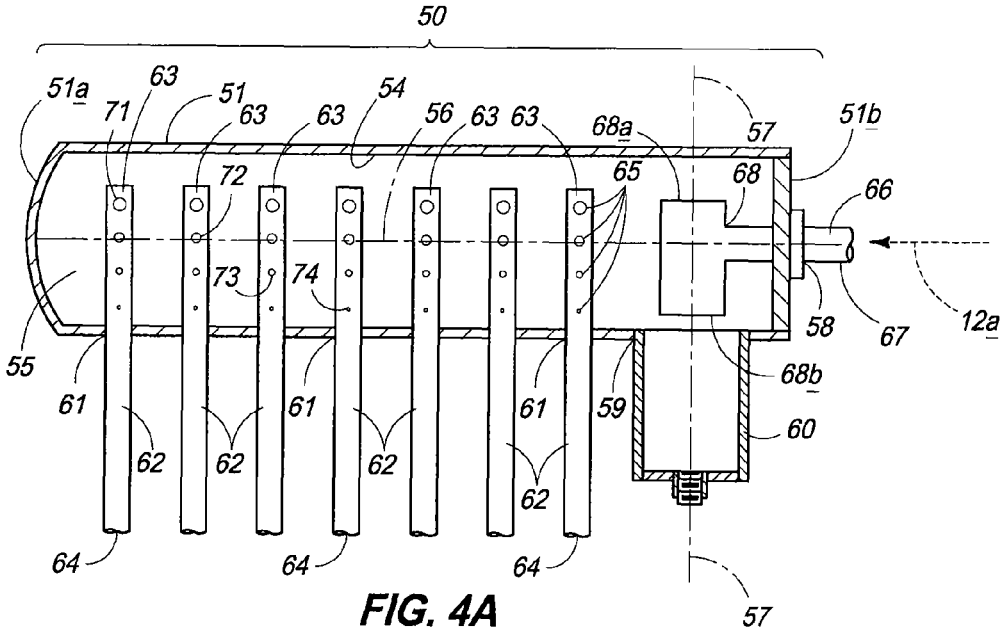
FIG. 4A is a longitudinal, transverse, vertical sectional view taken through a refrigerant distributor which forms a feature of the present invention.

Referring now to FIGS. 4 and 4A, it should be understood that the present invention 80 includes a liquid ammonia refrigerant distributor which is generally indicated by the numeral 50, and which forms a feature of the present invention. As seen in FIG. 4A, the liquid ammonia refrigerant distributor includes a tank 51, which is substantially elongated and typically assumes a cylindrical shape. However, it should be recognized that while FIG. 4A shows a tank 51 having a substantially cylindrical shape, other tank shapes may be employed with equal success in the present invention. The tank 51, as depicted in FIGS. 4 and 4A has a main body 52, and is substantially horizontally disposed or oriented. The tank 51 is defined by an outside facing surface 53, and an opposite inside facing surface 54. The inside facing surface 54 defines an internal cavity 55 having a given volume. The tank 51 includes opposite end walls 51A and 51B, respectively. Additionally, as shown in FIG. 4A, the main body 52 of the tank 51 is defined by a generally longitudinally disposed axis 56, and a transversely disposed axis 57.

A first aperture 58 is formed within end wall 51A of the tank 51. This first aperture 58 is substantially coaxially aligned relative to the longitudinal axis 56 of the main body 52. Still further, and formed in the main body 52 is an enlarged second aperture 59 for receiving, at least in part, a contaminant collection container 60. Additionally, as depicted in FIG. 4A, there is formed within the main body 52 a plurality of spaced refrigerant distributor conduit apertures 61 which permit individual refrigerant distributor conduits 62 to extend therethrough. These structures are discussed in greater detail below. Depending upon the form of the invention, the plurality of refrigerant distributor conduit apertures 61 may be oriented at given predetermined distances along the main body 52.

Referring further to FIG. 4A, and as can be seen in that drawing, the individual refrigerant distributor conduits 62 are operable to provide the source of liquid ammonia refrigerant 12A to the liquid ammonia refrigerant feed manifold 86, as will be discussed in greater detail, below. As illustrated clearly in FIG. 4A, the plurality of refrigerant distributor conduits 62 each have a first end 63 which is received within the internal cavity 55. As can be recognized by a study of FIG. 4A, the first ends 63 of each of the individual refrigerant distributor conduits 62 are located in substantially parallel, spaced relation, one relative to the others, and are substantially vertically oriented within the internal cavity 55 of the tank 51. The respective refrigerant distributor conduits each have a second end 64, which is best seen in FIG. 4, and which are further located outside of the tank 51, and which, additionally, are coupled in refrigerant delivering relation relative to a novel liquid ammonia refrigerant feed manifold 86, and which will be discussed in greater detail in the paragraphs which follow. A multiplicity of apertures 65 are formed within the first end 63 of each of the refrigerant distributor conduits 62. These multiplicity of apertures 65 each have a cross sectional or diametral dimension which diminishes in dimension when that cross sectional or diametral dimension is measured from the first end 63 of the respective refrigerant distributor conduit 62, and in the direction of the second end 64 thereof. These variably sized multiplicity of apertures 65 facilitate the substantial equal flow of liquid ammonia refrigerant 12A out through the refrigerant distributor conduits 62 as the volume of liquid ammonia refrigerant 12A increases within the tank 51.

The multiplicity of apertures 65 which are formed within the first end 63 of the respective refrigerant distributor conduits 62 includes first, second, third and fourth, pairs of substantially coaxially aligned apertures. These respective pairs of apertures are indicated by the numerals 71, 72, 73 and 74, respectively. With regards to these pairs of apertures, they have individual cross sectional or diametral dimensions which lie in the range of about 1.0 mm to about 5.0 mm. As can be best seen in FIG. 4A, it will be understood that these pairs of apertures 65 are all located within the internal cavity 55 of the tank 51, and each of the pairs of apertures 65 are located at a given distance from the first end 63 of the respective refrigerant distributor conduits 62. In this regard, the first pair of apertures 71 are located at about 0.25 inches from the first end 63 thereof. The second pair of apertures 72 are located at about 0.625 inches from the first end 63 thereof. Further, the third pair of apertures 73 are located at about 1.0 inch from the first end 63 thereof. Additionally, the fourth pair or apertures 74 are located at about 1.3 inches from the first end 63 thereof. A possible fifth, sixth and seventh pair of apertures are possible, but not shown.

The first pair of apertures 71 each have a similar diametral dimension of about 0.187 inches. Further, the second pair of apertures, 72 each have a similar diametral dimension of about 0.125 inches. Additionally, the third pair of apertures 73 each have a similar diametral dimension of about 0.0625 inches. Finally, the fourth pair of apertures 74 each have a similar diametral dimension of about 0.0469 inches. The applicant has discovered that the diametral dimensions as provided, above, including the spacing between the respective pairs of apertures, provides a convenient means for controlling the flow of the liquid ammonia refrigerant 12A from the internal cavity 55 of the tank 51 in a manner not possible, heretofore. The spacing between the pairs of apertures 71-74, respectively, and the diametral dimensions of the individual multiplicity of apertures 65 also provides a convenient means whereby the refrigerant distributor 50 may be operated over a wider range of cooling loads not possible with refrigerant distributors constructed in accordance with prior art teachings.

The refrigerant distributor 50 further includes an inlet conduit 66 which is operable to deliver the source of the refrigerant 12A to the internal cavity 55 of the tank 51. The inlet conduit 66 has a first, intake end 67, and an opposite, second, exhaust end 68 which is located within the internal cavity 55. The second, exhaust end 68, is defined by upper and lower exhaust apertures 68A and 68B respectively. The lower exhaust aperture is located in fluid delivering relation relative to the containment collection container 60.

Referring now to FIG. 4, the present invention 80 is illustrated in a typical operational arrangement. As can be appreciated from a study of FIG. 4, the liquid ammonia distributor tank 50, as shown in FIG. 4A, and discussed in detail, above, distributes substantially equal amounts of liquid ammonia refrigerant 12A, regardless of the physical state of the refrigerant, to the individual freezer plates or heat exchanger portions 81 of the present invention 80. As can be seen from a study of FIG. 4, the present invention 80 has an external appearance similar to that of the prior art, as shown in FIG. 1, inasmuch as the present invention 80 includes a plurality of flexible hoses or conduits 13 which are coupled in fluid flowing relation to a novel direct contact freezer plate or heat exchanger portion 81. Further, the flexible hoses or conduits 13 are connected to the new, and novel liquid ammonia refrigerant manifold 86, and the new, direct contact freezer plates, or heat exchanger portions 81 through the use of stainless steel threaded fittings 14*a* and 14*b*, respectively. The plurality of new, direct contact freezer plates 81, utilized in the present invention 80, are connected through conventional means to form a continuous direct contact freezing surface, such as by welding and other fastening means. However, the similarities of the prior art and the present invention 80 end with the external appearance of the direct contact freezer plates 81.

Figure 6:
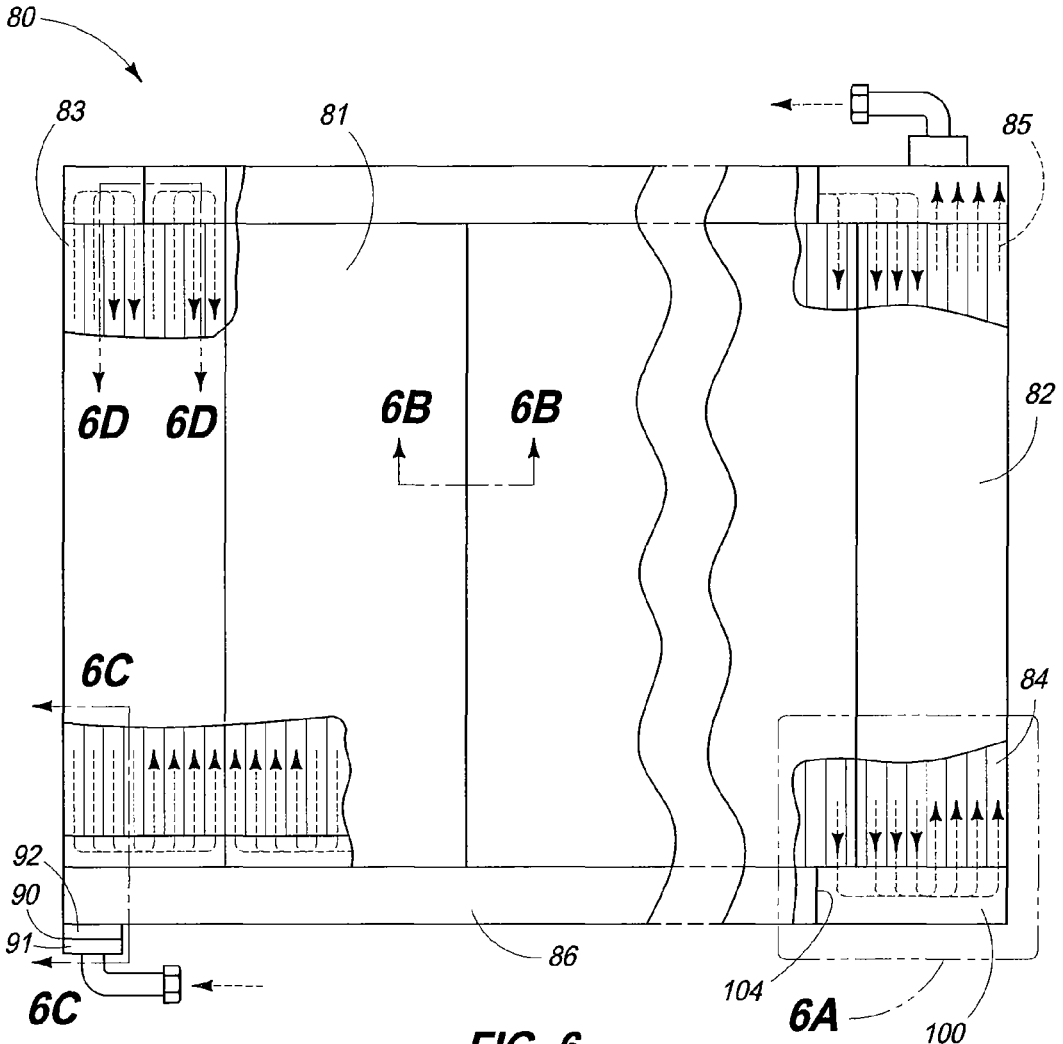
FIG. 6 is a great simplified, schematic, top plan view of a portion of a plate freezer portion of the present invention, and with some surfaces removed to show the structure thereunder.

Referring now to FIG. 6, a greatly simplified, schematic, top plan view of a portion of the freezer plate, or heat exchanger portion 81 of the present invention 80 is illustrated. This structure includes a plurality of extruded aluminum planks 82 which are each defined by a multiplicity of round, internal passageway 83, which are discussed in greater detail, hereinafter. Each of the plurality of extruded aluminum planks 81 has a first end 84 and a second end 85. The structure of the present invention 80 further includes a, novel header, or intake manifold, or refrigerant supply assembly 86. The header plate, intake manifold or refrigerant supply assembly 86 is attached to the first end 84 of each of the extruded aluminum planks 82 by conventional fastening means, such as by welding (FIG. 6C) or the like. The structure, as illustrated, further includes a bimetallic coupling 90, which has a stainless steel portion 91, and an aluminum portion 92 which are fused together by employing means such as roll bonding or explosion welding. The bimetallic coupler is coupled as by welding (FIG. 6C), to the refrigerant supply assembly or intake manifold 86 and will be discussed in greater detail, hereinafter. As can be appreciated by a study of FIG. 6, the ammonia refrigerant 12A, once introduced to the extruded aluminum planks 81, flows back and forth through the round internal passageways 83 so as to provide consistent and substantially even heat exchange throughout the entirety of the direct contact freezing surface of the plate 81 which defines a portion of the present invention 80. This movement of the refrigerant is most accurately characterized as stratified-wavy, but the wicking structure now mitigates the effects of this type of flow.

Figure 6A:
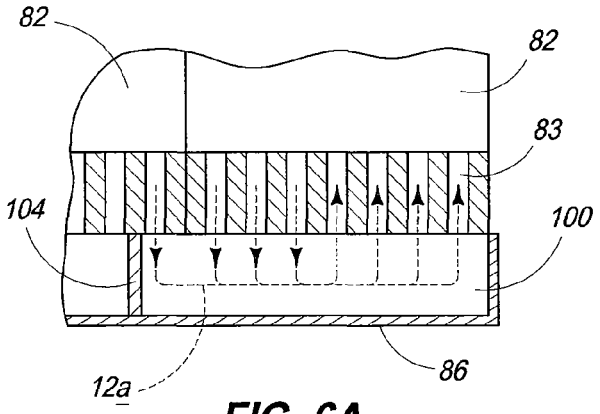
FIG. 6A is a top plan view showing an enlarged, fragmentary portion of the internal structure of the novel plate freezer of the present invention.
Figure 6C:
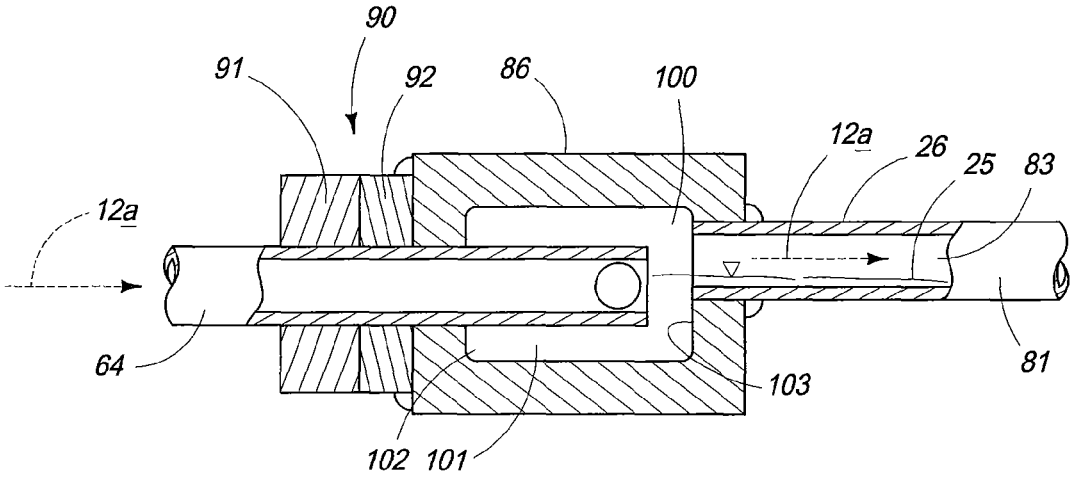
FIG. 6C is an enlarged, fragmentary, vertical, sectional view taken from a position along line 6C-6C of FIG. 6.
Figure 6D:
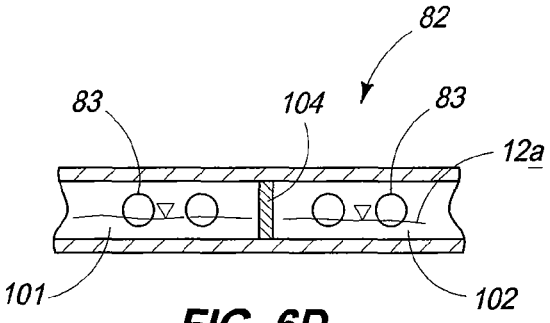
FIG. 6D is again an enlarged, fragmentary, longitudinal, vertical, sectional view taken from a position along line 6D-6D of FIG. 6.
Figure 7:
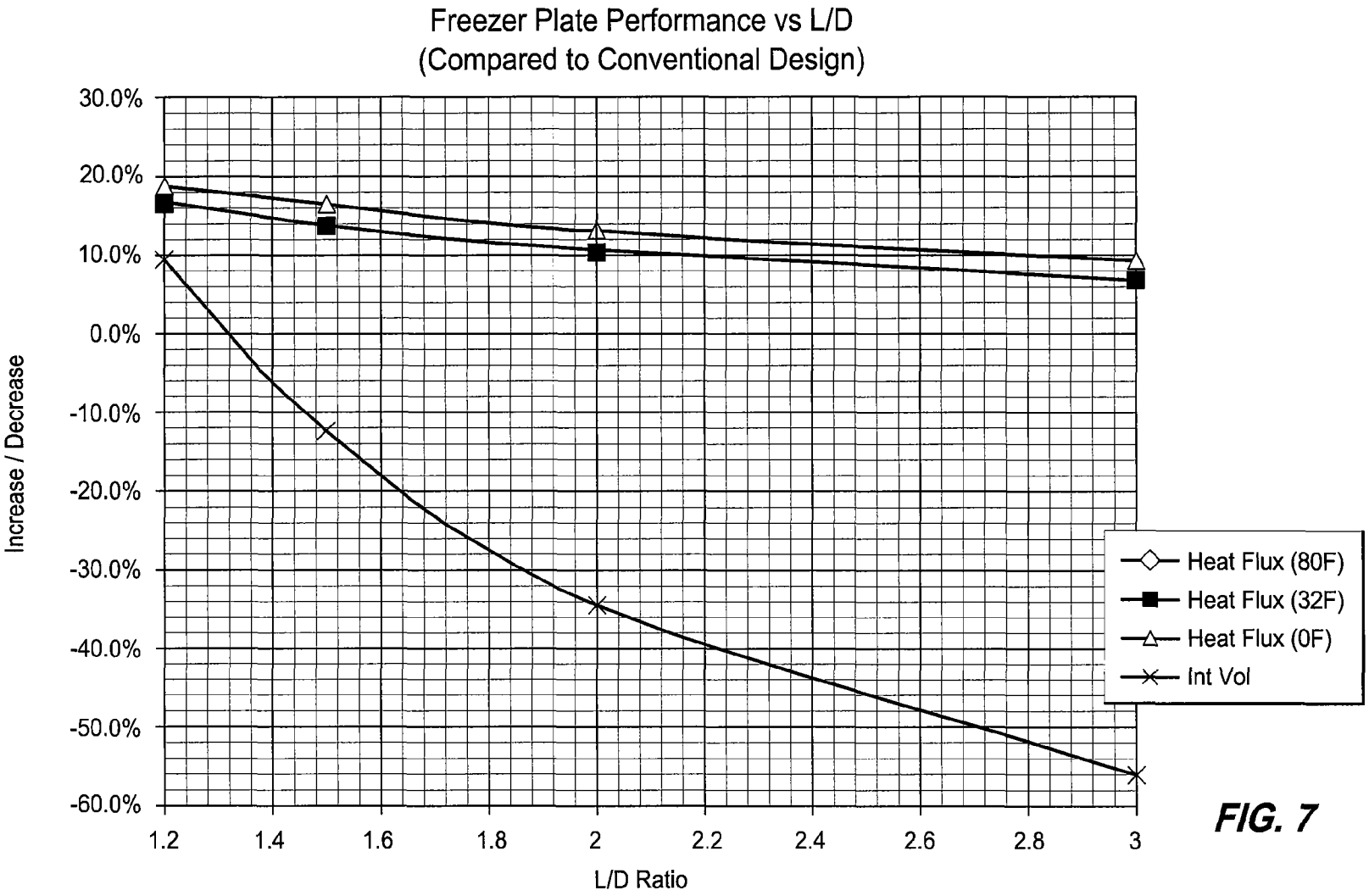
FIG. 7 is a graphical depiction of the refrigeration performance of the present invention with reported L/D performance as compared to a prior art design.

Referring now to FIG. 6A, which illustrates a top plan, enlarged view of a portion of the internal structure of the novel freezer plate 81 of the present invention 80, the refrigerant supply assembly or intake manifold 86 is defined by an elongated internal passageway 100. The internal passageway has a lower portion 101 (FIG. 6C) which acts as a reservoir 102, and further defines a weir 103 which collects the liquid ammonia refrigerant 12A which is being distributed or supplied by the bimetallic coupling 84, and which further returns or directs the flow of the refrigerant 12A through the round internal passageways 83 of each of the extruded aluminum planks 82. The reservoir 102 further operates to change the direction of the flow of liquid ammonia refrigerant 12A about 180 degrees as the liquid ammonia refrigerant 12A exits the round internal passageways 83 of one of the extruded aluminum planks 82, and enters the round internal passageways 83 of a neighboring extruded aluminum plank 82, by utilizing a plurality of baffles 104 which are located at predetermined, spaced distances along the internal passageway 100 (FIG. 6A). The respective baffles 104, and the weir 103, ensure that substantially equal amounts of liquid ammonia refrigerant 12A is distributed from the reservoir 102 to each of the round internal passageways 83 of the extruded aluminum planks 82, regardless of the respective percentages of liquid phase and vapor phase constituents 25 and 26 of the liquid ammonia refrigerant 12A. The advantageous performance of the present invention is seen in FIG. 7.

Figures 5, 5A, 5B, 5C:
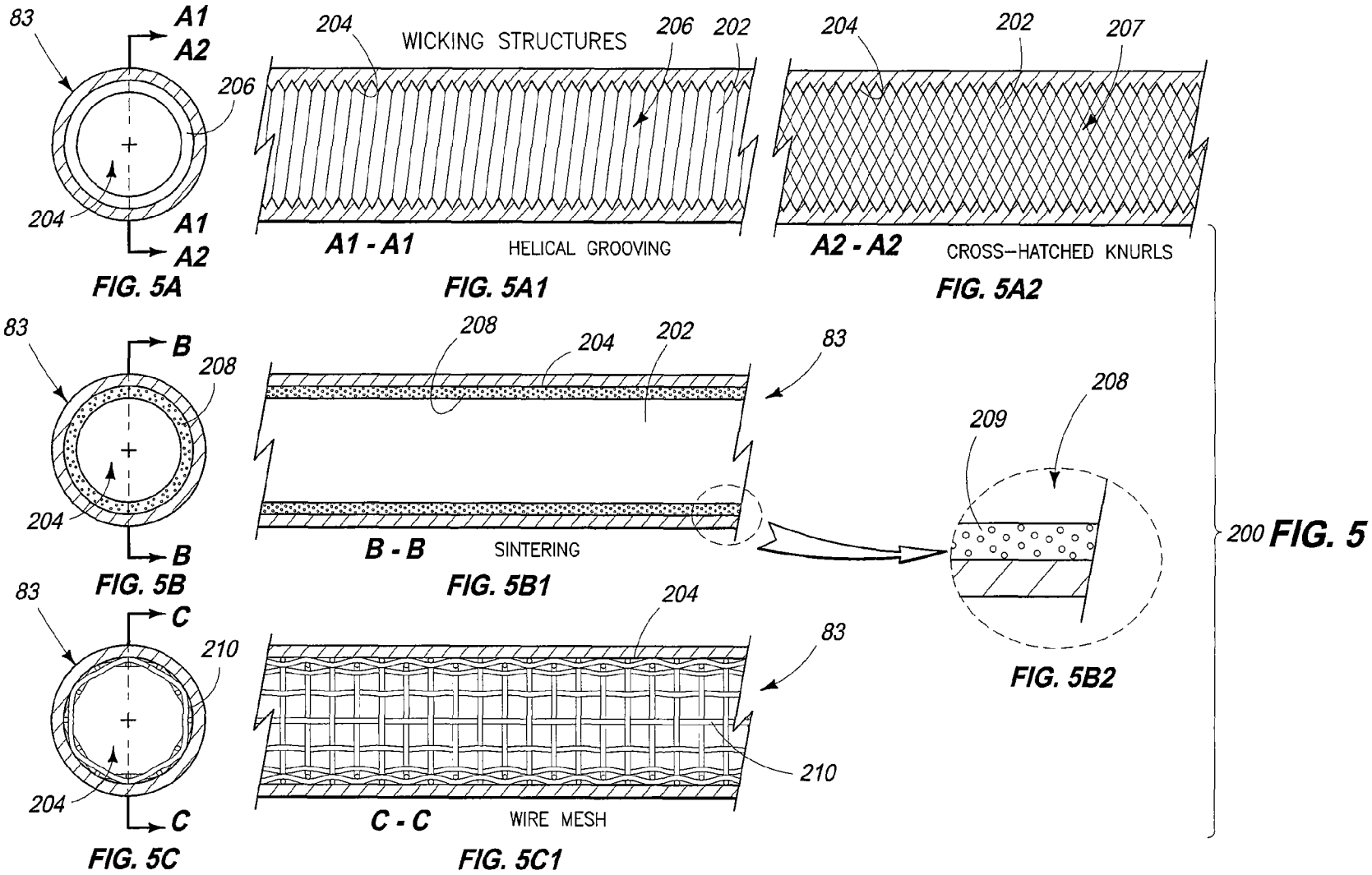
FIG. 5 shows four exemplary, and non-limiting embodiments of wicking structures which form a feature of the present invention.
FIG. 5A is a transverse, vertical, sectional view taken through one form of wicking structure which finds usefulness in the present invention.
FIG. 5B is a transverse, vertical, sectional view taken through another form of the invention.
FIG. 5C is a transverse, vertical, sectional view of yet another form of the present invention.

Referring now to FIG. 5, various wicking structures 200 which constitute a feature of the present invention 80 are shown. As illustrated, one aspect of the present invention 80 relates to a plurality of round passageways 83 which are formed in the new novel, direct contact freezer plate or heat exchanger portions 81 as earlier described. It should be understood, the round passageways 83 define a cavity 202 which allows a source of the liquid ammonia refrigerant 12A to pass therethrough. Referring now to FIGS. 5A and 5A1, a first form of the present invention is illustrated and which includes two possible wicking structures. The inside facing surface 204 which defines the round passageways 83 are individually coupled in fluid receiving relation relative to a source of a liquid ammonia refrigerant 12A. The first wicking structure which enhances the cooling performance of this structure is indicated by the numeral 206, and is illustrated as helical grooving which is formed in the inside facing surface 204. In this arrangement, capillary action, facilitated by the wicking structure 206, causes the liquid ammonia refrigerant 12A to be drawn up onto, and alongside, the inside facing surface 204 which defines the round passageways 83 of the direct contact plate freezer 81. This capillary action substantially mitigates the negative effects of the stratified and/or wavy flow patterns 34 of the liquid ammonia refrigerant 12A within the respective round passageway 83. The wicking structure 206 as seen in this form of the invention comprises a multiplicity of helical grooves having a depth of about 0.005 to about 0.05 inches; a spacing of about 0.01 to about 0.10 inches; and a lead angle of about 15° to about 90° respectively. Referring now to FIG. 5A2, a second form 207 of the wicking structure 200 is shown. The round passageway 83, in this form of the invention includes a wicking structure which is again formed into the inside facing surface 204, and which comprises a multiplicity of cross-hatched knurls 207 which are formed into the inside facing surface 204 of the respective round passageways 83. These cross-hatched knurls 207 are dimensioned so as to generate the desired capillary action as discussed, above. In the arrangement as seen in FIG. 5A2, the respective cross-hatch knurls 207 have a length of about 0.005 to about 0.05 inches; a spacing of about 0.01 to about 0.10 inches; and a lead angle of about 15° to about 90° respectively.

Referring now to FIGS. 5B, 5B1 and 5B2 a third form 208 of the wicking structure 200 comprises a feature of the present invention. In this form of the invention the present invention includes a plurality of passageways 83 which are formed in the direct contact plate freezer 81, and which have a wicking structure 208 which comprises a sintered metal coating which is deposited upon the inside facing surface 204 of the respective round passageways 83. This sintered metal coating 208 is effective in drawing the liquid ammonia refrigerant 12A, by capillary action, up onto the inside facing surface 204 of the respective round passageways 83. In the arrangement as seen in FIGS. 5B, 5B1 and 5B2, the sintered metal coating is formed from a metal selected from the group comprising stainless steel, nickel, copper and/or aluminum. Still further in this arrangement [FIG 5B2], the sintered metal coating 208 is formed to have a plurality of pores 209 having a pore radius of about 0.001 to about 0.04 cm. In yet another form of the wicking structure 200 of the present invention, and as seen in FIGS. 5C and 5C1, the wicking structure 200 comprises a wire mesh which is generally indicated by the numeral 210. The wire mesh has a size ranging from about 60 to about 450 openings per square inch. Again, the wire mesh 210 is formed from metal selected from the group comprising stainless steel; nickel; copper; and/or aluminum. All forms of the invention as seen in FIG. 5 produce an effective capillary action so as to facilitate the advantageous operation of the present invention.

Figure 6B:
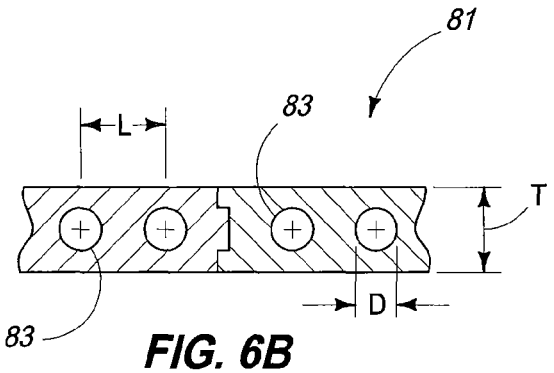
FIG. 6B is an enlarged, transverse, vertical, sectional view taken from a position along line 6B-6B of FIG. 6.

A feature of the present invention relates to the advantageous formation of the respective plurality of round passageways 83 in the direct contact plate freezer plates or heat exchanger portions 81. In this regard, it should be understood that the direct contact freezer plates or heat exchanger portions 81 comprise metal plates formed of individual metal planks 82 which are fastened together, and wherein the internal passageways 83 formed in the respective individual planks 82 are substantially circular in cross section and have a predetermined diametral dimension as indicated in FIG. 6B. In this arrangement the internal passageways 83 are further located at a predetermined distance or pitch from an adjacent internal passageway 83 labeled L in FIG. 6B. The ratio of the L/D is greater than about 1.3. It has been found that this pitch versus diametral relationship provides advantageous cooling for the new and novel invention 80 as depicted. The advantageous performance relative to the prior art assemblies is graphically depicted in FIG. 7.

OPERATION

In its broadest aspect, the present invention comprises a heat exchanger 80 which includes a heat exchanger portion 81 defining a multiplicity of internal passageway 83, and wherein at least one of the passageways 83 is defined, at least in part, by a wicking structure 200. In this broadest aspect of the invention, a refrigerant distributor 50 is coupled in fluid flowing relation relative to each of the internal passageways 83 of the heat exchanger portion 81. Still further, a source of an ammonia refrigerant 12A is supplied to the internal passageways 83 of the heat exchanger portion 81 by the refrigerant distributor 50. The source of refrigerant 12A is first provided to the refrigerant distributor 50 and further has a liquid and a vapor phase condition 25 and 26, respectively. The source of ammonia refrigerant 12A is further supplied to the refrigerant distributor 50 at a given flow rate. The refrigerant distributor 50 distributes substantially equal amounts of the ammonia refrigerant 12A to each of the internal passageways 83 of the heat exchanger portion 81 regardless of the liquid or vapor condition 24 or 25 respectively of the ammonia refrigerant 12A, or the refrigerant flow rate which is supplied to the refrigerant distributor 50.

Another aspect of the present invention relates to a heat exchanger 80 which includes a plurality of heat exchanger portions 81 each defining a multiplicity of internal passageways 83. At least some of the internal passageways 83 are defined, at least in part, by a wicking structure 200. The invention includes a refrigerant supply assembly 86 having a weir 103 which is mounted on each of the respective heat exchanger portions 81. Further the refrigerant supply assembly 86 is further coupled in fluid flowing relation relative to the multiplicity of internal passageways 83. The invention 80 further includes a refrigerant distributor 50 which supplies substantially equal amounts of a source of refrigerant 12A to each of the respective refrigerant supply assemblies 86. The invention also includes a plurality of refrigerant delivery conduits 13 which couple the respective refrigerant supply assemblies 86 in fluid flowing relation with refrigerant distributor 50. Further the invention includes a bimetallic coupler 90 which is affixed in fluid flowing relation relative to each of the refrigerant supply assemblies 86, and one of the refrigerant delivery conduits 13. In the present invention 80, the multiplicity of the internal passageways 83 are defined by an internal wall 204, and wherein the respective internal passageways 83 allow for the movement of the source of the refrigerant 12A. The wicking structure 200 is made integral with the internal wall 204. In the arrangement as shown in the drawings the wicking structure 200 is selected from the group comprising helical grooves 206, knurling, 207, sintered metal 208, and wire mesh 210, and which are respectively, individually, located on, or in contact with, the internal wall 204, and which defines the respective internal passageways 83. The various wicking structures 200 are effective, by capillary force, to draw the liquid refrigerant 12A up onto the internal wall 204 which defines the respective internal passageways 83. In the arrangement as seen in the drawings, the respective heat exchanger portions 81, and the refrigerant supply assembly 86 are fabricated from aluminum. Still further, the weir 103 extends along at least a portion of a length dimension of the refrigerant supply assembly 86, and wherein the weir 103 controls the flow of the liquid refrigerant 12A which is supplied to the respective internal passageways 83 of each of the heat exchanger portions 81. Additionally, in the invention 80 as disclosed, a multiplicity of baffles 104 are located in predetermined spaced relation along the length of the refrigerant supply assembly 86, and which are individually effective to change a direction of movement of the liquid refrigerant 12A which is moving along the respective internal passageways 83 which are defined by the heat exchanger portions or direct contact freezer plates 81.

Still another aspect of the present invention relates to a heat exchanger 80 which particularly includes a plurality of heat exchanger portions 81, and which each has formed therein a multiplicity of internal passageways 83 that are defined by an internal wall 204, and which individually allows for the movement of a source of refrigerant 12A having both liquid and vapor portions 25 and 26 respectively, therethrough. The internal passageways 83 are defined, at least in part, by a wicking structure 200 which is effective, by capillary force, to draw the liquid refrigerant 12A up onto the internal wall 204, and which defines the respective internal passageways 83. The plurality of heat exchanger portions 81 further include metal plates which are formed of individual metal planks 82 and which are fastened together. The internal passageways 83 formed in the respective planks are substantially circular in cross section, and have a predetermined diametral dimension D as seen in FIG. 6B, and wherein the internal passageways 83 are further located at a predetermined distance or pitch from an adjacent internal passageway [L], and wherein the ratio of the L/D is greater than about 1.3. The present invention 80 includes a refrigerant supply assembly 86 which is mounted on each of the heat exchanger portions 81, and which is further coupled in fluid flowing relation relative to the internal passageways 83 which are defined by the individual heat exchanger portions 81. Each of the refrigerant supply assemblies 86 has a weir 103 which controls the flow of the liquid refrigerant 12A which is supplied to the respective internal passageways 83 that are defined by the individual heat exchanger portions 81. The refrigerant supply assembly 86 further has a main body 87 with opposite first and second ends 88 and 89, respectively, and which defines an internal cavity or passageway 100 that extends between the opposite first and second ends. The internal cavity or passageway 100 defines a reservoir 102 for receiving the liquid refrigerant 12A which is delivered to the liquid supply assembly 86 by a refrigerant distributor 50. The weir 103 is made integral with a refrigerant supply assembly 86, and is operable to control the flow of the liquid refrigerant 12A which is supplied to the reservoir 102 and to the respective internal passageways 83. A plurality of baffles 104 are mounted within the internal cavity 100 of the refrigerant supply assembly 86, and which are located in predetermined spaced relation between the first and second ends 88 and 89 thereof. The respective baffles 104 are individually operable to redirect the flow of the source of the refrigerant 12A and which is flowing along the respective internal passageways 83. The present invention 80 further includes a refrigerant distributor 50 which supplies substantially equal amounts of the source of the refrigerant 12A to each of the respective refrigerant supply assemblies 86. The refrigerant distributor includes a tank 50 which defines an internal cavity 55 for receiving the source of the refrigerant 12A which has both a liquid and a vapor portion 25 and 26, respectively. The refrigerant distributor 50 further has an inlet conduit 66 for delivering the source of the refrigerant 12A to the internal cavity 55 of the tank 51. The inlet conduit has a first intake end 67, and a second exhaust end 68, which is located within the internal cavity 55 of the tank 51. The second exhaust end 68 is defined by an upper and lower exhaust aperture 68A and 68B respectively. Still further the refrigerant distributor 50 includes a contaminant collection container 60 which is coupled in fluid receiving relation relative to the internal cavity 55 of the tank 51. The second exhaust aperture 68B of the inlet conduit 66 is disposed in fluid delivering relation relative thereto. The present invention also includes a plurality of refrigerant distributor conduits 61 which are coupled in fluid receiving relation relative to the internal cavity 55 of the tank 51. Each of the refrigerant distributor conduits has a first intake end 63, and a second exhaust end 64. The first intake end 63 of the respective refrigerant distributor conduits 61 are substantially vertically oriented within the internal cavity 55 of the tank 51. Further, a multiplicity of apertures 65 are formed in each of the first end 63 of the respective refrigerant distributor conduits 61. The multiplicity of apertures 65 each have a cross-sectional dimension which diminishes when the cross-sectional dimension is measured from the first intake end of the respective refrigerant distributor conduit 61, and in the direction of the second exhaust end 64, thereof. The second exhaust end 64 is coupled in fluid flowing relation relative to the respective refrigerant supply assemblies 86. Further the present invention 80 includes a bimetallic coupler 90 which is affixed to each of the respective refrigerant supply assemblies 86, and to the respective second exhaust end 64 of each of the individual refrigerant distributor conduit 61.

Therefore it will be seen that the present invention provides a convenient means whereby high value food products may be chilled and otherwise refrigerated to a convenient amount in a manner not possible heretofore. Still further, the present invention avoids many of the shortcomings associated with the prior art teachings, and additionally provides a convenient means for refrigerating objects of interest by utilizing highly volatile refrigerants in a more effective manner and at lower refrigerant volumes thereby preventing or eliminating dangers associated with using such refrigerants.

In compliance with the statute, the invention has been described in language more or less specific as the structural and methodical features. It is to be understood, however, that the invention is not limited to the specific features shown and described since the means herein disclosed compromise preferred forms of putting the invention into effect. The invention is, therefore, claimed in any of the forms or modifications within the proper scope of the appended claims appropriately interpreted in accordance with the Doctrine of Equivalents.

What I claim is:

1. A heat exchanger, comprising:

a heat exchanger portion defining a multiplicity of internal passageway, and wherein at least one of the passageways is defined, at least in part, by a wicking structure;

a refrigerant distributor coupled in fluid flowing relation relative to each of the internal passageways of the heat exchanger portion; and a source of an ammonia refrigerant which is supplied to the internal passageways of the heat exchanger portion by the refrigerant distributor, and wherein the source of refrigerant is first provided to the refrigerant distributor, and further has a liquid and vapor phase condition, and wherein the source of the ammonia refrigerant is further supplied to the refrigerant distributor at a given flow rate, and wherein the refrigerant distributor distributes substantially equal amounts of the ammonia refrigerant to each of the internal passageways of the heat exchanger portion regardless of the liquid or vapor phase condition of the ammonia refrigerant, or the refrigerant flow rate which is supplied to the refrigerant distributor.

2. A heat exchanger as claimed in claim 1, and further comprising:

a refrigerant supply assembly mounted in fluid flowing relation relative to each of internal passageways of the heat exchanger portion, and is further coupled in fluid receiving relation relative to the refrigerant distributor, and wherein the refrigerant supply assembly has a weir which controls the flow of the ammonia refrigerant which is supplied to the respective internal passageways of the heat exchanger portion.

3. A heat exchanger as claimed in claim 2, and further comprising:

a refrigerant delivery conduit coupling, in fluid flowing relation, the refrigerant distributor, and the refrigerant supply assembly, and wherein the refrigerant supply assembly is fabricated from a first metal substrate, and the refrigerant delivery conduit is fabricated from a second metal substrate.

4. A heat exchanger as claimed in claim 3, and further comprising:

a bimetallic coupler which defines a fluid passageway which extends therethrough, and which couples the refrigerant delivery conduit in fluid flowing relation relative to the refrigerant supply assembly, and wherein the bimetallic coupler has a first and a second portion which are joined together by roll bonding or explosion welding, and wherein the first portion of the bimetallic coupler is fabricated of the first metal substrate, and the second portion is fabricated of the second metal substrate.

5. A heat exchanger as claimed in claim 4, and wherein the wicking structure is selected from the group comprising helical grooves; knurling; sintered metal; and wire mesh, and which are respectively, individually, located in at least one of the internal passageways, and wherein the wicking structure is effective, by capillary force, to draw the liquid refrigerant up onto the internal wall which defines the respective internal passageways so as to reduce a stratified-wavy flow pattern associated with the ammonia refrigerant as the ammonia refrigerant flows along the individual passageways at a low mass flux rate, and a low temperature.

6. A heat exchanger as claimed in claim 5, and wherein the heat exchanger portion comprises a plurality of heat exchanger portions, and wherein the plurality of heat exchanger portions each comprise metal plates formed of individual metal planks which are fastened together, and wherein the internal passageways formed in the respective metal planks are substantially circular in cross-section, and have a predetermined diametral dimension (D), and wherein the internal passageways are further located at a predetermined spacial distance or pitch from an adjacent internal passageway (L), and wherein the ratio of L/D is greater than about 1.3, and wherein the internal shape and spacing of internal passageways reduces the amount of ammonia refrigerant supplied to the respective heat exchanger portions.

7. A heat exchanger as claimed in claim 6, and further comprising:

a multiplicity of baffles located in predetermined, spaced relationship along a length dimension of the refrigerant supply assembly, and which are individually effective to change a direction of flow of the liquid refrigerant moving along the respective internal passageways.

8. A heat exchanger as claimed in claim 1, and wherein the refrigerant distributor further comprises:

a tank having an interior facing surface, and which defines an internal cavity for receiving the source of the refrigerant which has both the liquid and vapor phase condition;

an inlet conduit penetrating the internal cavity, and which delivers the source of refrigerant to the internal cavity of the tank, and wherein the inlet conduit has a first, intake end, and a second exhaust end, and wherein the second, exhaust end is located within the internal cavity of the tank, and wherein the second, exhaust end is defined by an upper and a lower aperture in the shape of a T, and wherein the T-shaped exhaust end is substantially vertically oriented within the internal cavity; and a contaminant collection container coupled in fluid flowing relation with the internal cavity, and which collects the liquid phase refrigerant for distribution, and which is received from the second exhaust end of the inlet conduit, and wherein the source of the refrigerant has a contaminant therein, and wherein the contaminant settles-out of the liquid phase refrigerant, over time, and under the influence of gravity, in the contaminant collection container, and is later removed therefrom, and wherein the first, intake end of each of the respective refrigerant distribution conduits are received within, and vertically oriented relative to, the internal cavity of the tank, and wherein each of the respective first, intake ends have formed therein a multiplicity of apertures which each have a predetermined cross-sectional dimension, and wherein the cross-sectional dimension of the respective apertures diminishes when the cross-sectional dimension is measured from the intake end of the refrigerant distribution conduit, and in the direction of the second discharge end thereof, and wherein the multiplicity of apertures facilitates the substantially equal supply of the source of the refrigerant to each of the refrigerant distribution conduits.

9. A heat exchanger as claimed in claim 8, and wherein the multiplicity of apertures formed in the first intake end of the respective refrigerant distributor conduits each have a diametral dimension which lies in a range of about 0.0469 inches to about 0.187 inches.

10. A heat exchanger as claimed in claim 9, and wherein the first portion of the bimetallic coupler and the first metal substrate are each fabricated from aluminum, and wherein the second portion of the bimetallic coupler, and the second metal substrate are each fabricated from stainless steel.

11. A heat exchanger, comprising:

a plurality of heat exchanger portions each defining a multiplicity of internal passageways, and wherein at least some of the internal passageways are defined, at least in part, by a wicking structure;

a refrigerant supply assembly having a weir, and which is mounted on each of the respective heat exchanger portions, and which is further coupled in fluid flowing relation relative to the multiplicity of internal passageways;

a refrigerant distributor which supplies substantially equal amounts of a source of a refrigerant to each of the respective refrigerant supply assemblies;

a plurality of refrigerant delivery conduits coupling the respective refrigerant supply assemblies in fluid flowing relation with the refrigerant distributor; and a bimetallic coupler which is affixed in fluid flowing relation relative to each of the refrigerant supply assemblies and with one of the refrigerant delivery conduits.

12. A heat exchanger as claimed in claim 11, and wherein the multiplicity of internal passageways are defined by an internal wall, and wherein the respective internal passageways allow for the movement of the source of refrigerant, and wherein the source of the refrigerant has a liquid and vapor phase portion, and wherein the wicking structure is made integral with the internal wall.

13. A heat exchanger as claimed in claim 11, and wherein the wicking structure is selected from the group comprising helical grooves; knurling; sintered metal;

and wire mesh, and which are respectively, individually, located on the internal wall which defines the respective internal passageways, and wherein the wicking structure is effective, by capillary force, to draw the liquid refrigerant up onto the internal wall which defines the respective internal passageways.

14. A heat exchanger as claimed in claim 11, and wherein the plurality of heat exchanger portions comprise metal plates formed of individual metal planks which are fastened together, and wherein the internal passageways formed in the respective metal planks are substantially circular in cross-section, and have a predetermined diametral dimension (D), and wherein the internal passageways are further located at a predetermined distance or pitch from an adjacent internal passageway (L), and wherein the ratio of L/D is greater than about 1.3.

15. A heat exchanger as claimed in claim 11, and wherein the respective heat exchanger portions, and the refrigerant supply assembly are fabricated from aluminum, and wherein the weir extends along at least a portion of a length dimension of the refrigerant supply assembly, and wherein the weir controls the flow of the liquid refrigerant which is supplied to the respective internal passageways of each of the heat exchanger portions.

16. A heat exchanger as claimed in claim 15, and further comprising:

a multiplicity of baffles located in predetermined, spaced relationship along the length of the refrigerant supply assembly, and which are individually effective to change a direction of flow of the liquid refrigerant moving along the respective internal passageways.

17. A heat exchanger as claimed in claim 15, and wherein the bimetallic coupler comprises:

a mounting block which is mounted in fluid flowing relation relative to the refrigerant supply assembly, and wherein the mounting block is formed of an aluminum, first portion, which is coupled to the refrigerant supply assembly, and a stainless steel second portion, and which is located in spaced relationship relative to the refrigerant supply assembly, and wherein the second, stainless steel portion is joined to the first aluminum portion by explosive welding or roll bonding, and wherein a fluid passageway extends through the first and second portions of the mounting block.

18. A heat exchanger as claimed in claim 17, and wherein the respective refrigerant delivery conduits have a first, intake end, which is located in fluid receiving relation relative to the refrigerant distributor, and a second discharge end which is fluid flowingly secured to the fluid passageway which is defined by the mounting block, and is further affixed to the second portion of the mounting block, and wherein the respective refrigerant delivery conduits are fabricated from stainless steel.

19. A heat exchanger as claimed in claim 18, and wherein the refrigerant distributor further comprises:

a tank having an interior facing surface, and which defines an internal cavity for receiving the source of the refrigerant which has both a liquid and vapor phase portion;

an inlet conduit penetrating the internal cavity, and which delivers the source of refrigerant to the internal cavity of the tank, and wherein the inlet conduit has a first, intake end, and a second exhaust end, and wherein the second, exhaust end is located within the internal cavity of the tank, and wherein the second, exhaust end is defined by an upper and a lower aperture in the shape of a T, and wherein the T-shaped exhaust end is substantially vertically oriented within the internal cavity; and a contaminant collection container coupled in fluid flowing relation with the internal cavity, and which collects the liquid phase refrigerant for distribution, and which is received from the second exhaust end of the inlet conduit, and wherein the source of the refrigerant has a contaminant therein, and wherein the contaminant settles-out of the liquid phase refrigerant, over time, and under the influence of gravity, in the contaminant collection container, and is later removed therefrom, and wherein the first, intake end of each of the respective refrigerant distribution conduits are received within, and vertically oriented relative to, the internal cavity of the tank, and wherein each of the respective first, intake ends have formed therein a multiplicity of apertures which each have a predetermined cross-sectional dimension, and wherein the cross-sectional dimension of the respective apertures diminishes when the cross-sectional dimension is measured from the intake end of the refrigerant distribution conduit, and in the direction of the second discharge end thereof, and wherein the multiplicity of apertures facilitates the substantially equal supply of the source of the refrigerant to each of the refrigerant distribution conduits.

20. A heat exchanger as claimed in claim 19, and wherein the multiplicity of apertures formed in the first intake end of the respective refrigerant distributor conduits each have a diametral dimension which lies in a range of about 0.0469 inches to about 0.187 inches.

21. A heat exchanger, comprising:

a plurality of heat exchanger portions, and which each has formed therein a multiplicity of internal passageways that are defined by an internal wall, and which individually allow for the movement of a source of a refrigerant, having both liquid and vapor portions, therethrough, and wherein the internal passageways are defined, at least in part, by a wicking structure which is effective, by capillary force, to draw the liquid refrigerant up onto the internal wall, and which defines the respective internal passageways;

a refrigerant supply assembly mounted on each of the heat exchanger portions, and which is further coupled in fluid flowing relation relative to the respective internal passageways which are defined by the individual heat exchanger portions, and wherein each of the refrigerant supply assemblies has a weir which controls the flow of the liquid refrigerant which is supplied to the respective internal passageways that are defined by the individual heat exchanger portions;

a refrigerant distributor which supplies substantially equal amounts of the source of the refrigerant to each of the respective refrigerant supply assemblies;

a plurality of refrigerant delivery conduits each having a first, intake end which is coupled in fluid receiving relationship relative to the refrigerant distributor, and a second, refrigerant discharge end which is coupled in fluid delivering relationship relative to each of the respective refrigerant supply assemblies; and a bimetallic coupler which is affixed to each of the respective refrigerant supply assemblies, and to the respective refrigerant discharge end of each of the individual refrigerant delivery conduits.

22. A heat exchanger as claimed in claim 21, and wherein the plurality of heat exchanger portions comprise metal plates formed of individual metal planks which are fastened together, and wherein the internal passageways formed in the respective planks are substantially circular in cross-section, and have a predetermined diametral dimension (D), and wherein the internal passageways are further located at a predetermined distance or pitch from an adjacent internal passageway (L), and wherein the ratio of L/D is greater than about 1.3.

23. A heat exchanger as claimed in claim 21, and wherein the wicking structure is selected from the group comprising helical grooves; knurling; sintered metal; and wire mesh, all of which are individually located on the internal wall which defines the respective internal passageways.

24. A heat exchanger as claimed in claim 21, and wherein the refrigerant supply assembly has a main body with opposite first and second ends, and which defines an internal cavity that extends between the opposite first and second ends, and wherein the internal cavity defines a reservoir for receiving the liquid refrigerant delivered to the liquid supply assembly by the refrigerant distributor, and wherein the weir is made integral with the refrigerant supply assembly, and is operable to control the flow of the liquid refrigerant supplied to the reservoir to the respective internal passageways.

25. A heat exchanger as claimed in claim 24, and wherein the refrigerant discharge end of the respective refrigerant delivery conduits are coupled in fluid flowing relation relative to the internal cavity of the respective refrigerant supply assemblies, and wherein the respective refrigerant discharge ends of each of the refrigerant delivery conduits are welded to the respective bimetallic couplers.

26. A heat exchanger as claimed in claim 25, and wherein the refrigerant supply assembly further comprises:

a plurality of baffles which are mounted within the internal cavity of the refrigerant supply assembly and which are located in predetermined spaced relation between the first and second ends thereof, and which individually operate to redirect the flow of the source of the refrigerant flowing along the respective internal passageways.

27. A heat exchanger as claim in claim 21, and wherein the metal planks, and the refrigerant supply assembly are each fabricated from aluminum, and wherein the respective refrigerant delivery conduits are fabricated from stainless steel, and wherein the bimetallic coupler comprises a coupler which is formed from a substrate having an aluminum portion, and a stainless steel portion, which are roll bonded or explosion welded together, and wherein the stainless steel refrigerant delivery conduits are welded to the stainless steel portion of the bimetallic coupler, and wherein the aluminum portion of the bimetallic coupler is welded to the refrigerant supply assembly.

28. A heat exchanger as claimed in claim 21, and wherein the refrigerant distributor further comprises:

a tank defining an internal cavity for receiving the source of refrigerant which has both a liquid and vapor portion;

an inlet conduit for delivering the source of the refrigerant to the internal cavity of the tank, and wherein the inlet conduit has a first intake end, and second exhaust end which is located within the internal cavity of the tank, and wherein the second, exhaust end is defined by an upper and lower exhaust aperture;

a contaminant collection container coupled in fluid receiving relation relative to the internal cavity of the tank, and wherein the second exhaust aperture of the inlet conduit is disposed in fluid delivering relation relative thereto, and wherein the first intake end of the respective refrigerant distributor conduits are substantially vertically oriented within the internal cavity of the tank, and a multiplicity of apertures are formed in each of the first ends of the respective refrigerant distributor conduits, and wherein the multiplicity of apertures each have a cross-sectional dimension which diminishes when the cross-sectional dimension is measured from the first intake end of respective refrigerant distributor conduits, and in the direction of the second exhaust end thereof, and wherein the second, exhaust end is coupled in fluid flowing relation relative to the respective refrigerant supply assemblies.

29. A heat exchanger as claimed in claim 28, and wherein the multiplicity of apertures formed in the first intake end of the respective refrigerant distributor conduits each have a diametral dimension which lies in a range of about 0.0469 inches to about 0.187 inches.

30. A heat exchanger as claimed in claim 22, and wherein the respective metal planks are supplied with substantially equal amounts of the source of the refrigerant by way of the refrigerant supply assembly and the action of the weir, and wherein the wicking structure draws the liquid refrigerant up onto circular shaped internal walls of the individual passageways so as to provide substantially uniform cooling of the respective heat exchanger portions, and which further reduces the volume of the refrigerant required to achieve a predetermined amount of cooling.

31. A heat exchanger, comprising:

a plurality of heat exchanger portions, and which each has formed therein a multiplicity of internal passageways that are defined by an internal wall, and which individually allow for the movement of a source of a refrigerant, having both liquid and vapor portions, therethrough, and wherein the internal passageways are defined, at least in part, by a wicking structure which is effective, by capillary force, to draw the liquid refrigerant up onto the internal wall, and which defines the respective internal passageways, and wherein the plurality of heat exchanger portions further include metal plates which are formed of individual metal planks which are fastened together, and wherein the internal passageways formed in the respective planks are substantially circular in cross-section, and have a predetermined diametral dimension (D), and wherein the internal passageways are further located at a predetermined distance or pitch from an adjacent internal passageway (L), and wherein the ratio of L/D is greater than about 1.3;

a refrigerant supply assembly mounted on each of the heat exchanger portions, and which is further coupled in fluid flowing relation relative to the respective internal passageways which are defined by the individual heat exchanger portions, and wherein each of the refrigerant supply assemblies has a weir which controls the flow of the liquid refrigerant which is supplied to the respective internal passageways that are defined by the individual heat exchanger portions, and wherein the refrigerant supply assembly further has a main body with opposite first and second ends, and which defines an internal cavity that extends between the opposite first and second ends, and wherein the internal cavity defines a reservoir for receiving the liquid refrigerant delivered to the liquid supply assembly by the refrigerant distributor, and wherein the weir is made integral with the refrigerant supply assembly and is operable to control the flow of the liquid refrigerant supplied to the reservoir to the respective internal passageways; and wherein a plurality of baffles are mounted within the internal cavity of the refrigerant supply assembly and which are located in predetermined spaced relation between the first and second ends thereof, and which individually operate to redirect the flow of the source of the refrigerant flowing along the respective internal passageways;

a refrigerant distributor which supplies substantially equal amounts of the source of the refrigerant to each of the respective refrigerant supply assemblies; and wherein the refrigerant distributor includes a tank defining an internal cavity for receiving the source of refrigerant which has both a liquid and vapor portion; an inlet conduit for delivering the source of the refrigerant to the internal cavity of the tank, and wherein the inlet conduit has a first intake end, and a second exhaust end which is located within the internal cavity of the tank, and wherein the second, exhaust end is defined by an upper and lower exhaust aperture; a contaminant collection container coupled in fluid receiving relation relative to the internal cavity of the tank, and wherein the second exhaust aperture of the inlet conduit is disposed in fluid delivering relation relative thereto;

a plurality of refrigerant distributor conduits coupled in fluid flowing relation relative to the internal cavity of the tank, and wherein each of the refrigerant distributor conduits has a first intake end, and a second exhaust end, and wherein the first intake end of the respective refrigerant distributor conduits are substantially vertically oriented within the internal cavity of the tank, and a multiplicity of apertures are formed in each of the first ends of the respective refrigerant distributor conduits, and wherein the multiplicity of apertures each have a cross-sectional dimension which diminishes when the cross-sectional dimension is measured from the first intake end of respective refrigerant distributor conduits, and in the direction of the second exhaust end thereof, and wherein the second, exhaust end is coupled in fluid flowing relation relative to the respective refrigerant supply assemblies; and a bimetallic coupler which is affixed to each of the respective refrigerant supply assemblies, and to the respective second exhaust end of each of the individual refrigerant delivery conduits.

* * * * *